US007427725B2

(12) United States Patent
Hou et al.

(10) Patent No.: US 7,427,725 B2
(45) Date of Patent: Sep. 23, 2008

(54) KEYBOARDS

(75) Inventors: Wen-Kuang Hou, Miaoli County (TW); Chih-Chieh Cheng, Taoyuan County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 11/840,157

(22) Filed: Aug. 16, 2007

(65) Prior Publication Data

US 2008/0047817 A1 Feb. 28, 2008

(30) Foreign Application Priority Data

Aug. 25, 2006 (TW) ..... 95131337 A
Feb. 2, 2007 (TW) ..... 96103849 A

(51) Int. Cl.
*H01H 13/70* (2006.01)

(52) U.S. Cl. ..... 200/512; 200/517; 200/341

(58) Field of Classification Search ..... 200/5 R, 200/5 A, 511–517, 341, 345; 341/22; 345/156, 345/168, 169, 172; 400/472–496
See application file for complete search history.

(56) References Cited

U.S. PATENT DOCUMENTS 5,508,479 A * 4/1996 Schooley ..... 200/5 R
5,579,002 A * 11/1996 Iggulden et al. ..... 341/23
6,140,593 A * 10/2000 Bramesfeld et al. ..... 200/5 A
6,680,676 B1 * 1/2004 Hayashi et al. ..... 341/22
6,841,748 B2 * 1/2005 Serizawa et al. ..... 200/512
6,995,326 B2 * 2/2006 Sugimura et al. ..... 200/5 R
7,034,235 B2 * 4/2006 Hosaka ..... 200/314
7,075,520 B2 * 7/2006 Williams ..... 345/169
7,094,979 B2 * 8/2006 Kurokawa et al. ..... 200/5 R
7,131,780 B2 * 11/2006 Hirsch ..... 400/485
7,259,339 B1 * 8/2007 Babella et al. ..... 200/5 A
7,262,379 B2 * 8/2007 Nishimura et al. ..... 200/314

* cited by examiner

*Primary Examiner*—Michael A Friedhofer
(74) *Attorney, Agent, or Firm*—Quintero Law Office

(57) ABSTRACT

A keyboard. A membrane circuit board includes a plurality of switches. At least one keycap is disposed on the membrane circuit board and includes a plurality of activating pillars respectively corresponding to and separated from the switches. When the keycap is moved toward the membrane circuit board, one of the activating pillars compresses one of the switches, outputting a signal corresponding to the keycap.

18 Claims, 4 Drawing Sheets

KEYBOARDS

BACKGROUND OF THE INVENTION

1. Field of the Invention

The invention relates to keyboards, and more particularly to keyboards providing enhanced operational sensitivity.

2. Description of the Related Art

A conventional key structure of a remote control comprises a keycap, a conductive elastomer, a switch (such as an edge connector), and a printed circuit board. The switch is disposed on the printed circuit board. The conductive elastomer is connected to the keycap and corresponds to the switch. An operator can press the keycap, forcing the conductive elastomer connected thereto to compress the switch. The switch is thus activated and outputs a corresponding signal.

Nevertheless, the conventional key structure has many drawbacks. To effectively activate the switch, the operator must press the center of the keycap. Specifically, when the operator presses corners of the keycap, the conductive elastomer often cannot compress the switch, causing ineffective operation of the key structure. Moreover, due to manufacturing considerations, the conventional key structure cannot provide waterproof and dustproof functions. Furthermore, the conductive elastomer often contains silicon oil. After long-term use, the conductive elastomer is easily broken and the silicon oil leaks from the interior thereof, causing damage to the entire key structure. Additionally, the conductive elastomer is expensive, such that the manufacturing costs of the key structure cannot be reduced.

Moreover, referring to FIG. 4, a conventional key structure 1 comprises a circuit board 10 and a key assembly 20. The key assembly 20 comprises multiple keys 21 and multiple protrusions 22. Each protrusion 22 corresponds to each key 21 and is disposed thereunder. When one of the keys 21 is pressed, the protrusion 22 disposed thereunder compresses the circuit board 10, outputting a corresponding signal.

Nevertheless, as the entire key assembly 20 often comprises soft material, power or kinetic energy from pressing the key 21 is offset by deformation of the key assembly 20. Displacement of the corresponding protrusion 22 is insufficient and thus the protrusion 22 cannot exactly compress the circuit board 10. Accordingly, the key 21 must be pressed again to function, causing inconvenience of operation. The aforementioned problem is particularly obvious with a multiple key.

Hence, there is a need for a keyboard providing soft tactile sensitivity for the operator and appropriate rigidity for efficient operation.

BRIEF SUMMARY OF THE INVENTION

A detailed description is given in the following embodiments with reference to the accompanying drawings.

An exemplary embodiment of the invention provides a keyboard comprising a membrane circuit board and at least one keycap. The membrane circuit board comprises a plurality of switches. The keycap is disposed on the membrane circuit board and comprises a plurality of activating pillars respectively corresponding to and separated from the switches. When the keycap is moved toward the membrane circuit board, the activating pillars compress the switches, outputting a signal corresponding to the keycap.

The keyboard further comprises at least one resilient member disposed between the keycap and the membrane circuit board and covering the switches and activating pillars.

The activating pillars are uniformly distributed over the keycap.

The activating pillars are distributed over the center and corners of the keycap, respectively.

The keycap comprises elastic material.

Another exemplary embodiment of the invention provides a keyboard comprising a membrane circuit board, a plurality of keycaps, and a reinforcement sheet. The membrane circuit board comprises a plurality of switches. The keycaps are disposed on the membrane circuit board and comprise elastic material. Each keycap comprises an activating pillar corresponding to each switch. One of the keycaps is provided with a multiple keycap. The reinforcement sheet is disposed between the multiple keycap and the membrane circuit board. The hardness of the reinforcement sheet exceeds that of the multiple keycap.

The keycap comprises rubber.

The reinforcement sheet comprises stiff plastic or metal.

The stiff plastic comprises PET.

The reinforcement sheet comprises a hole through which the activating pillar of the multiple keycap passes.

The reinforcement sheet is integrally formed with the multiple keycap by insert molding.

The reinforcement sheet is attached to the multiple keycap.

The multiple keycap comprises an Enter keycap, a Shift keycap, a Space keycap, or a Backspace keycap.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

First Embodiment

Figure 1A:
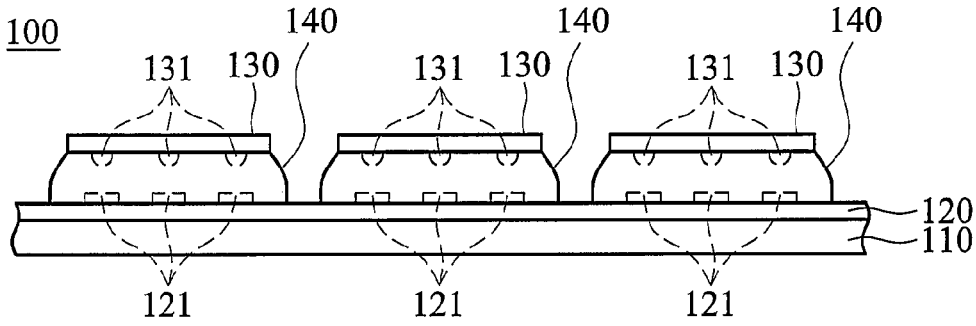
FIG. 1A is a partial side view of a keyboard of a first embodiment of the invention.
Figure 1B:
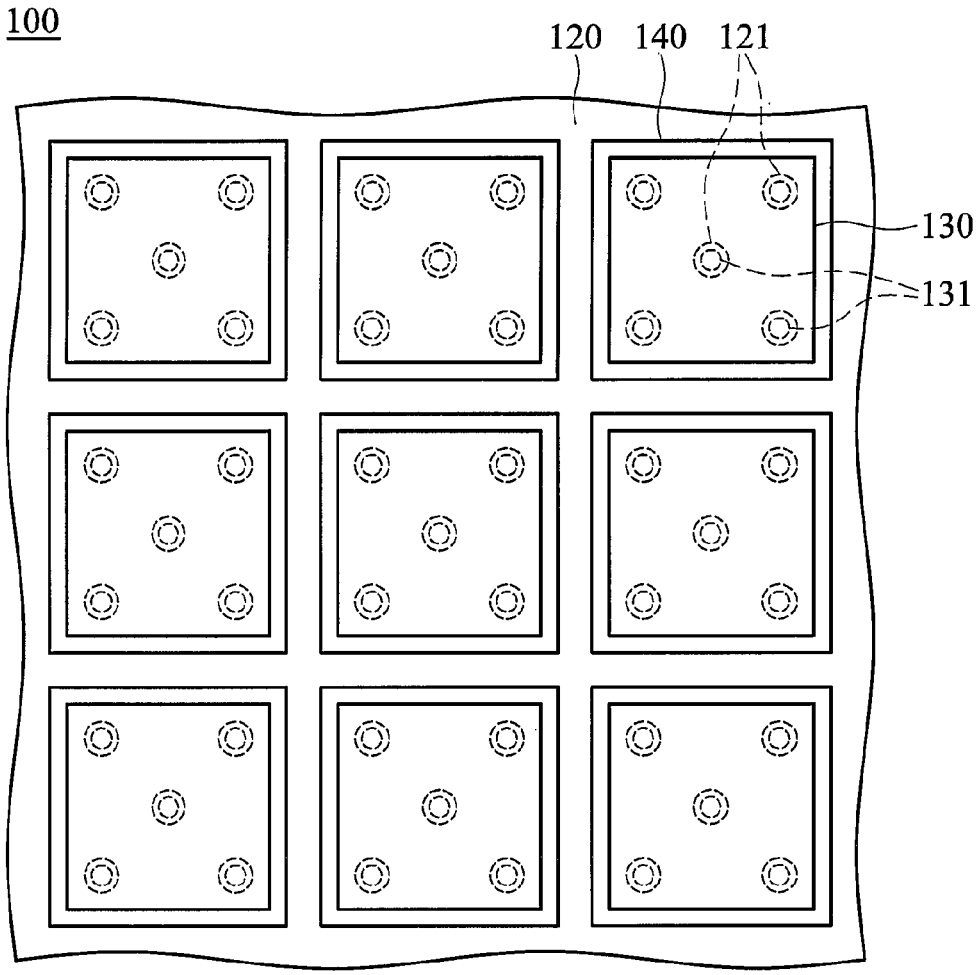
FIG. 1B is a partial top view of the keyboard of the first embodiment of the invention.

Referring to FIG. 1A and FIG. 1B, a keyboard 100 comprises a base plate 110, a membrane circuit board 120, a plurality of keycaps 130, and a plurality of resilient members 140.

The membrane circuit board 120 is disposed on the base plate 110 and comprises a plurality of switches 121.

The keycaps 130 are disposed on the membrane circuit board 120. Each keycap 130 comprises a plurality of activating pillars 131 respectively corresponding to and separated from the switches 121. Specifically, the disposition and number of the switches 121 of the membrane circuit board 120 correspond to those of the activating pillars 131 of the keycaps 130. Moreover, the activating pillars 131 are uniformly distributed over each keycap 130. More specifically, as shown in FIG. 1B, the activating pillars 131 are distributed over the center and corners of each keycap 130, respectively.

As shown in FIG. 1A and FIG. 1B, each resilient member 140 is disposed between each keycap 130 and the membrane circuit board 120 and covers the activating pillars 131 of each keycap 130 and the switches 121 corresponding thereto.

When a certain keycap 130 is pressed to move toward the membrane circuit board 120, the pillars 131 compress the switches 121, outputting a signal corresponding to the certain keycap 130. On the other hand, after being released, the certain keycap 130 returns to an original position by resilience provided by a corresponding resilient member 140.

Accordingly, uniformly distributed over each keycap 130 (or distributed over the center and corners of each keycap 130, respectively), the activating pillars 131 thereof can compress the switches 121 of the membrane circuit board 120 even though the center thereof is not pressed (i.e. only corners of the keycap 130 are pressed), thereby outputting a signal corresponding thereto. Ineffective operation of the keyboard 100 is thus prevented. Namely, operational sensitivity of the keyboard 100 is effectively enhanced, such that the keyboard 100 can provide convenient and rapid operation.

Moreover, as each resilient member 140 covers the activating pillars 131 of each keycap 130 and the switches 121 corresponding thereto, external particles (such as, water and dusts) cannot enter a space between each keycap 130 and the membrane circuit board 120. The keyboard 100 thus provides waterproof and dustproof functions.

Furthermore, the keyboard 100 omits conductive elastomers, thus providing reduced manufacturing costs and simplified assembly.

Additionally, the keyboard 100 provides extensive applicability. For example, the keyboard 100 can be applied as a remote control or a computer input device.

Second Embodiment

Figure 2A:
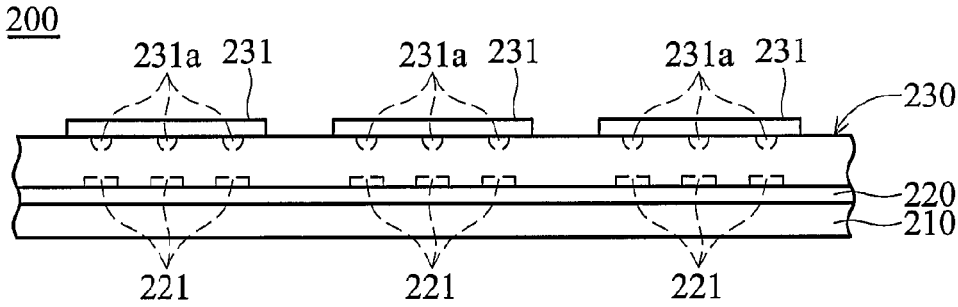
FIG. 2A is a partial side view of a keyboard of a second embodiment of the invention.
Figure 2B:
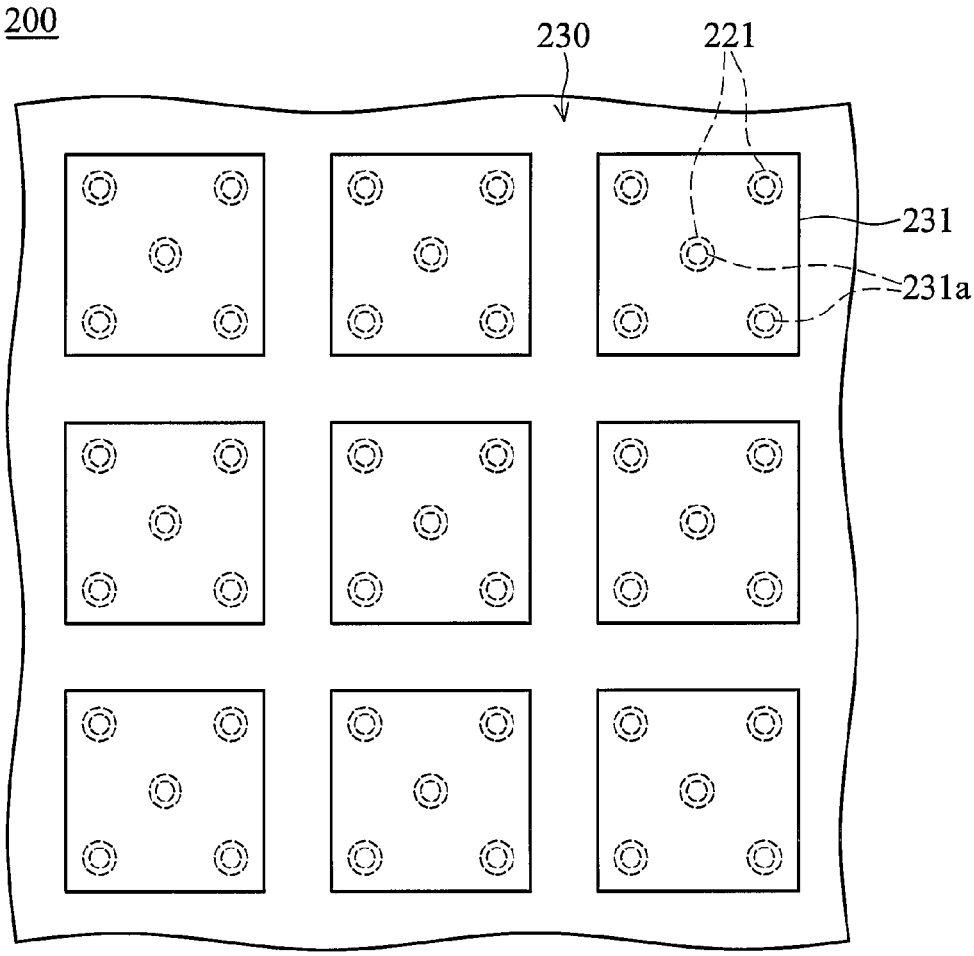
FIG. 2B is a partial top view of the keyboard of the second embodiment of the invention.

Referring to FIG. 2A and FIG. 2B, a keyboard 200 comprises a base plate 210, a membrane circuit board 220, and a key assembly 230.

The membrane circuit board 220 is disposed on the base plate 210 and comprises a plurality of switches 221.

The key assembly 230 is disposed on the membrane circuit board 220 and covers the switches 221 of the membrane circuit board 220. Moreover, the key assembly 230 comprises a plurality of keycaps 231. In this embodiment, the key assembly 230 comprises elastic material. Namely, the keycaps 231 comprise elastic material, such as rubber. Each keycap 231 comprises a plurality of activating pillars 231*a* respectively corresponding to and separated from the switches 221. Specifically, the disposition and number of the switches 221 of the membrane circuit board 220 correspond to those of the activating pillars 231*a* of the keycaps 230. Moreover, the activating pillars 231*a* are uniformly distributed over each keycap 231. More specifically, as shown in FIG. 2B, the activating pillars 231*a* are distributed over the center and corners of each keycap 231, respectively.

When a certain keycap 231 is pressed to move toward the membrane circuit board 220, the pillars 231*a* compress the switches 221, outputting a signal corresponding to the certain keycap 231. On the other hand, after being released, the certain keycap 231 returns to an original status by resilience itself.

Accordingly, uniformly distributed over each keycap 231 (or distributed over the center and corners of each keycap 231, respectively), the activating pillars 231*a* thereof can compress the switches 221 of the membrane circuit board 220 even though the center thereof is not pressed (i.e. only corners of the keycap 231 are pressed), thereby outputting a signal corresponding thereto. Ineffective operation of the keyboard 200 is thus prevented. Namely, operational sensitivity of the keyboard 200 is effectively enhanced, such that the keyboard 200 can provide convenient and rapid operation.

Moreover, as the key assembly 230 covers the switches 221 of the membrane circuit board 220, external particles (such as, water and dusts) cannot enter a space between the keycaps 231 and the membrane circuit board 220. The keyboard 200 thus provides waterproof and dustproof functions.

Similarly, the keyboard 200 omits conductive elastomers, thus providing reduced manufacturing costs and simplified assembly.

Similarly, the keyboard 200 provides extensive applicability. For example, the keyboard 200 can be applied as a remote control or a computer input device.

Third Embodiment

Figure 3A:
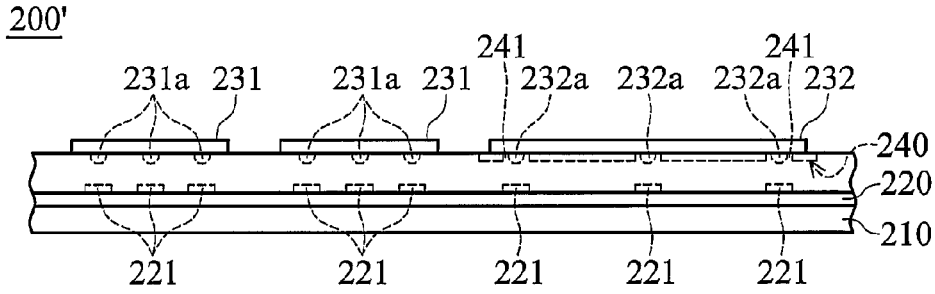
FIG. 3A is a partial side view of a keyboard of a third embodiment of the invention.
Figure 3B:
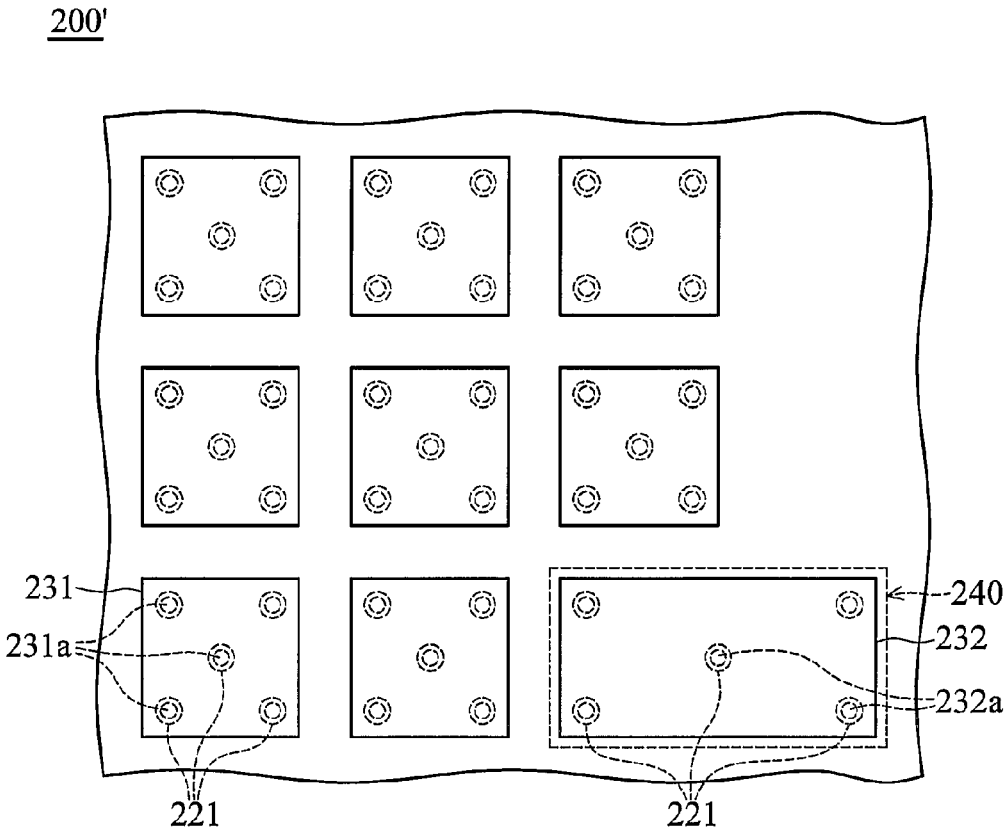
FIG. 3B is a partial top view of the keyboard of the third embodiment of the invention.
Figure 4:
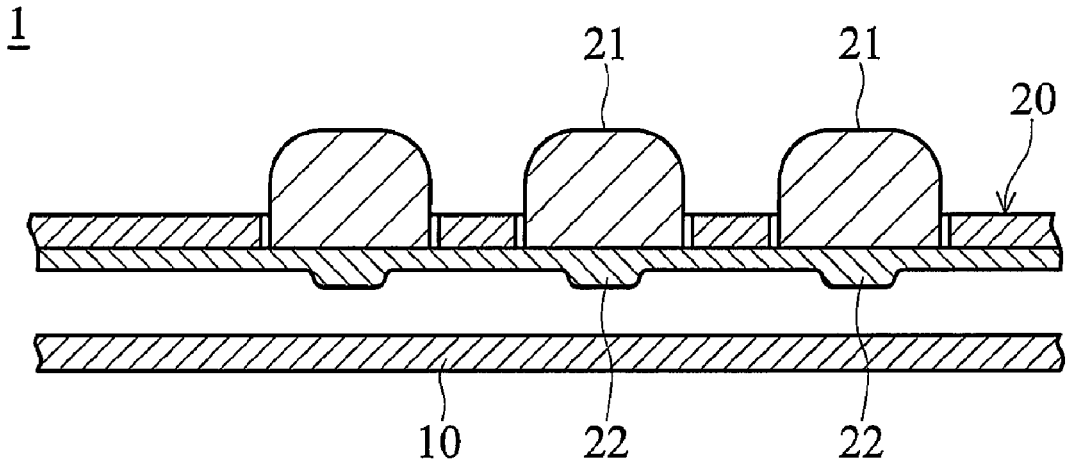
FIG. 4 (PRIOR ART)
FIG. 4 is a schematic partial cross section of a conventional key structure.

Referring to FIG. 3A and FIG. 3B, a keyboard 200' comprises a base plate 210, a membrane circuit board 220, a plurality of keycaps 231, a plurality of keycaps 232, and a plurality of reinforcement sheets 240 (FIG. 3A and FIG. 3B show only a keycap 232 and a reinforcement sheet 240 for simplicity of description).

The membrane circuit board 220 is disposed on the base plate 210 and comprises a plurality of switches 221.

The keycaps 231 and 232 are disposed on the membrane circuit board 220 and comprise elastic material, such as rubber. In this embodiment, the keycaps 231 are common keycaps and the keycaps 232 are multiple keycaps, such as an Enter keycap, a Shift keycap, a Space keycap, and a Backspace keycap. Namely, the size of each keycap 232 exceeds that of each keycap 231. Moreover, each keycap 231 comprises multiple activating pillars 231*a* and each keycap 232 comprises multiple activating pillars 232*a*. The position and number of the switches 221 of the membrane circuit board 220 correspond to those of the activating pillars 231*a* and activating pillars 232*a*. Namely, each activating pillar 231*a* or each activating pillar 232*a* corresponds to and is separated from each switch 221.

Each reinforcement sheet 240 is disposed between each keycap 232 (multiple keycap) and the membrane circuit board 220 and comprises a plurality of holes 241 (as shown in FIG. 3A) through which the activating pillars 232*a* of each keycap 232 (multiple keycap) respectively pass. Specifically, the hardness of the reinforcement sheets 240 exceeds that of the keycaps 232 (multiple keycaps). For example, the reinforcement sheets 240 may comprise stiff plastic (such as PET) or metal, such that the hardness of the reinforcement sheets 240 exceeds that of the keycaps 232 (multiple keycaps) comprising rubber. Moreover, each reinforcement sheet 240 may be attached to each keycap 232 (multiple keycap) or integrally formed with each keycap 232 (multiple keycap) by insert molding.

When the keycap 232 (multiple keycap) is pressed, the keycap 232 (multiple keycap) and reinforcement sheet 240 move toward the membrane circuit board 220. The activating pillars 232*a* of the keycap 232 (multiple keycap) compress the switches 221 of the membrane circuit board 220, outputting a signal corresponding to the keycap 232 (multiple keycap).

Accordingly, as the rubber keycap 232 (multiple keycap) combined with the reinforcement sheet 240 provides enhanced rigidity, hard and soft tactile sensitivity can be obtained when an operator presses the keycap 232 (multiple keycap). Moreover, as the rubber keycap 232 (multiple keycap) combined with the reinforcement sheet 240 provides enhanced rigidity, the switches 221 of the membrane circuit board 220 can be exactly compressed when the keycap 232 (multiple keycap) is pressed, reducing inconvenience of operation. Additionally, as the reinforcement sheet 240 is disposed between the keycap 232 (multiple keycap) and the membrane circuit board 220, aesthetical appearance of the keyboard 200' is not adversely affected.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A keyboard, comprising:

a membrane circuit board comprising a switch;

a keycap disposed on the membrane circuit board and comprising elastic material, wherein the keycap comprises an activating pillar corresponding to the switch; and a reinforcement sheet disposed between the keycap and the membrane circuit board, wherein the hardness of the reinforcement sheet exceeds that of the keycap, when the keycap is pressed, the keycap and reinforcement sheet move toward the membrane circuit board and the activating pillar of the keycap compresses the switch of the membrane circuit board, outputting a signal corresponding to the keycap.

2. The keyboard as claimed in claim 1, wherein the keycap comprises rubber.

3. The keyboard as claimed in claim 1, wherein the reinforcement sheet comprises stiff plastic.

4. The keyboard as claimed in claim 3, wherein the stiff plastic comprises PET.

5. The keyboard as claimed in claim 1, wherein the reinforcement sheet comprises metal.

6. The keyboard as claimed in claim 1, wherein the reinforcement sheet comprises a hole through which the activating pillar passes.

7. The keyboard as claimed in claim 1, wherein the reinforcement sheet is attached to the keycap.

8. The keyboard as claimed in claim 1, wherein the reinforcement sheet is integrally formed with the keycap by insert molding.

9. A keyboard, comprising:

a membrane circuit board comprising a plurality of switches;

a plurality of keycaps disposed on the membrane circuit board and comprising elastic material, wherein each keycap comprises an activating pillar corresponding to each switch, and one of the keycaps is provided with a multiple keycap; and a reinforcement sheet disposed between the multiple keycap and the membrane circuit board, wherein the hardness of the reinforcement sheet exceeds that of the multiple keycap, when the multiple keycap is pressed, the multiple keycap and reinforcement sheet move toward the membrane circuit board and the activating pillar of the multiple keycap compresses the corresponding switch of the membrane circuit board, outputting a signal corresponding to the multiple keycap.

10. The keyboard as claimed in claim 9, wherein the keycap comprises rubber.

11. The keyboard as claimed in claim 9, wherein the reinforcement sheet comprises stiff plastic.

12. The keyboard as claimed in claim 11, wherein the stiff plastic comprises PET.

13. The keyboard as claimed in claim 9, wherein the reinforcement sheet comprises metal.

14. The keyboard as claimed in claim 9, wherein the reinforcement sheet comprises a hole through which the activating pillar of the multiple keycap passes.

15. The keyboard as claimed in claim 9, wherein the reinforcement sheet is integrally formed with the multiple keycap by insert molding.

16. The keyboard as claimed in claim 9, wherein the reinforcement sheet is attached to the multiple keycap.

17. The keyboard as claimed in claim 9, wherein the multiple keycap comprises an Enter keycap.

18. The keyboard as claimed in claim 9, wherein the multiple keycap comprises a Shift keycap, a Space keycap, or a Backspace keycap.

* * * * *